US006336780B1

(12) United States Patent
Chasteen

(10) Patent No.: US 6,336,780 B1
(45) Date of Patent: Jan. 8, 2002

(54) BLANK EDGE REFORM METHOD AND APPARATUS FOR A CONTAINER END CLOSURE

(75) Inventor: Howard C. Chasteen, Golden, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 09/271,945

(22) Filed: Mar. 18, 1999

(51) Int. Cl.[7] ..... B21D 51/44

(52) U.S. Cl. ..... 413/8; 413/56; 72/348; 72/352; 72/360

(58) Field of Search ..... 413/8, 56; 72/336, 72/348, 353.2, 353.4, 353.6, 355.4, 360, 361

(56) References Cited

U.S. PATENT DOCUMENTS 1,890,936 A * 12/1932 Douglass ..... 413/8
3,933,023 A 1/1976 Tatsumi et al.
3,957,005 A * 5/1976 Heffner ..... 413/8
4,567,746 A * 2/1986 Bachmann et al. ..... 413/56
4,823,578 A 4/1989 Coe et al.
4,977,772 A * 12/1990 Bulso, Jr. et al. ..... 72/336
5,527,143 A * 6/1996 Turner et al. ..... 413/8

OTHER PUBLICATIONS

PCT International Search Report for International Application No. PCT/US00/08382.

* cited by examiner

*Primary Examiner*—Peter Vo
*Assistant Examiner*—Louis Huynh
(74) *Attorney, Agent, or Firm*—Sheridan Ross P.C.

(57) ABSTRACT

A non-precurled, non-curled shell is transferred to a reform station. The reform station contains a coin die and a coin punch. The coin die has the desired round finished blank diameter machined into its face. The die cavity has a round die wall which stops the outward flow of material during the coining process. The die wall produces the blank's final shape. During the coining process, the coining punch compresses the scalloped blank edge of the non-curled, non-precurled shell. The coined area causes material to flow outward, coming in contact with the die wall, forming the blanks outer perimeter.

26 Claims, 3 Drawing Sheets

BLANK EDGE REFORM METHOD AND APPARATUS FOR A CONTAINER END CLOSURE

The present invention relates to process for reforming the edge of a container opening cover and in particular to a method and apparatus for reforming the edge of a two piece or three piece shell before the shell is seamed to a container body to reduce scalloping or other irregularities in the shell perimeter.

BACKGROUND INFORMATION

A number of processes are used for closing or covering a container opening such as in the process of manufacturing and filling a two piece or three piece beverage or food container. Typically, a container body has a side wall which is substantially cylindrical with at least one substantially circular rim defining an open end of the container body. In a number of previous configurations, a container end shell which is substantially disk-shaped (although it may have various recesses, scores, indicia and the like) has a perimeter substantially the same shape as the container opening rim. The container may be closed by seaming the angular region of the shell perimeter to the rim region of the container body such as by a double seaming operation, as known to those of skill in the art.

In many situations, it is strongly preferred to maintain, at any circumferential position along the shell perimeter or the container body rim, a sufficient radial extent of the annular shell portion which is to be seamed, in proximity with the can body rim portion to which it is to be seamed, so as to assure that the seam will have structural integrity, form a desired, preferably hermetic, seal between the shell and the container body and will be able to withstand certain shocks or impacts such as those often encountered during transport, retailing, sale and normal end-user use.

A number of procedures often involved in providing or forming the shell 912 (FIGS. 9A and 9B) result in a shell whose perimeter departs from perfect regularity (typically, departs from perfect circularity) such as when portions of the shell periphery are somewhat indented or scalloped, as compared to a perfect circular form. These departures of the shell periphery from ideal regularity contribute to container configurations in which the amount of material provided to achieve the seaming operations exceed the materials that are, at least theoretically, minimally required. For example, when, to achieve the desired seaming integrity, an annular region with a radial extent of X is needed, if the shell edge is scalloped inwardly by radial extent equal to Y, the shell must be provided with an annular seaming region having a nominal or intended radial extent of about X+Y (so that, even in portions of the annular region where scalloping occurs, the radial extent will be at least equal to the nominal or intended extent of X+Y, less the maximum scalloping defect of Y, to provide a guaranteed minimum radial extent of X, as desired).

For this reason, some shell formation and/or seaming operations provide a double seam which is larger than that which would be theoretically minimally required, in order to maintain seam integrity even in the face of an amount of shell edge scalloping. Accordingly, it would be useful to provide a procedure which can reduce or eliminate the adverse effects of scalloping on seam sizes, so as to provide for containers with rugged and integral seams but with a reduced seam size.

In many container-forming procedures, it is desirable to provide seaming regions (or other regions) of the container end closure shell which has a degree of hardness, e.g. to assist in maintaining seam integrity, regardless of normal shocks or impacts on the container. To provide for proper seaming, the shell typically must have a diameter suited to the container body rim diameter, but which also has sufficient thickness to provide and maintain a reliable seam. Accordingly, it would be advantageous to provide a shell which provides for at least regions that are hardened, particularly in the annular seaming area. It would be advantageous to provide a process for forming shells that results in at least some increase in effective shell diameter, without thinning regions of the shell to the point that structural integrity may be compromised.

SUMMARY OF THE INVENTION

The present invention involves subjecting the shell or shell blank to the application of a forming operation such as coining, spinning or die-forming at least in the periphery or seaming area of the shell, prior to the seaming operation. Preferably, if coining is used, the coining operation involves use of a die having a wall which can define the desired (typically, regular) shape of the shell periphery, so that coining may reform a shell from a shape which may have scalloped or otherwise irregular edges to a shape which has substantially regular, substantially unscalloped edges. Preferably, the present invention allows the formation of containers having a seam size smaller than the seam size provided in correspondingly-shaped containers formed by previous procedures, substantially without sacrificing integrity or durability of the seam. The coining operation preferably provides an increase in the diameter of the shell (at least some locations around the circumference) all having relatively minor effects on the thickness of the coined region. Preferably, the coining achieves a degree of work-hardening of the coined area, which may help to offset the effects of any diminution of thickness caused by the coining operation.

In one embodiment, a non-precurled, non-curled shell is transferred to a reform station. This station contains a coin die and coin punch. The coin die has the desired round finished blank diameter machined into the die face. The die cavity has a round die wall which stops the outward flow of material during the coining process. The die wall produces the blank's final shape. During the coining process, the coining punch compresses the scalloped blank edge of the non-curled, non-precurled shell. Coining of the coined area causes the material to flow outward until it comes in contact with the die wall, forming the blanks outer diameter. This corrects the scalloped edge of the blanks and additionally work hardens the edge and increases the blank diameter. This configuration can also eliminate the need for (expensive) non-round cut edge tooling.

DETAILED DESCRIPTION

Figure 3:
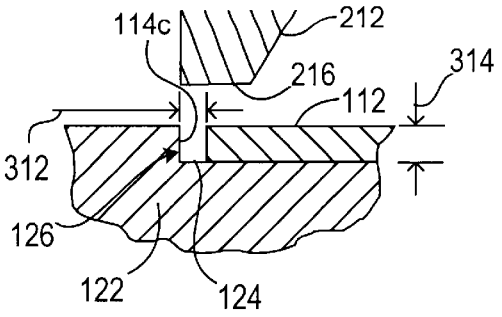
FIG. 3 is an enlarged detail of region 3 of FIG. 2.

In typical situations, a container end shell 112 is formed of a metal, such as an aluminum alloy. As depicted in FIG. 2, the container end shell 112, while roughly circular in shape, may have departures from strict circularity such as having one or more inwardly indented or scalloped regions 114*a,b,c,d* defining earring gaps. The departures from regularity can arise from a number of sources including imperfections in the original cutting or stamping of the planar or disk-shaped blank, shaping procedures such as stamping or other procedures for forming the annular recess 116 and/or the raised 118 periphery of the shell and may have contributions from the metallurgy of the shell and/or imperfections in tooling concentricity. In any case, it is common for a shell such as that depicted in FIGS. 1 and 2 to have at least one and often plurality of scallops or earring gaps 114*a–d*. The radial extent 312 (FIG. 3) of the gap will, as shown, typically vary along the circumference of the shell. In a typical shell intended for use in forming a typical 12 ounce beverage container, the gap 312 is commonly no greater than about 0.0050 inches although there can be substantial variation in this value. The resultant variations in uncurled lip height lead to a double seam size which is greater than desired, thus increasing the material cost of the container.

Figure 9A:
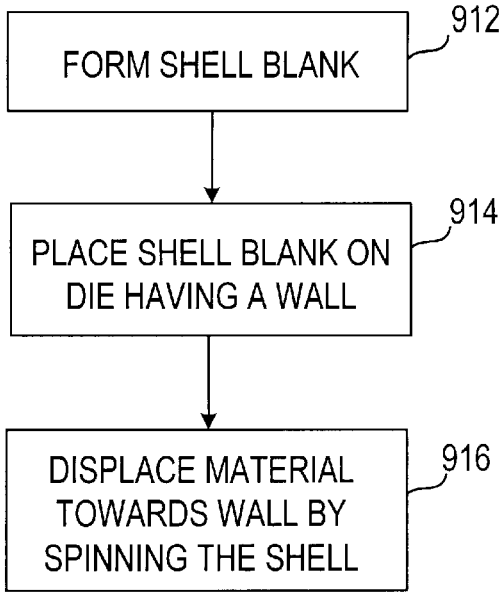
FIGS. 9A and 9B are flow charts of processes according to embodiments of the present invention.
Figure 9B:
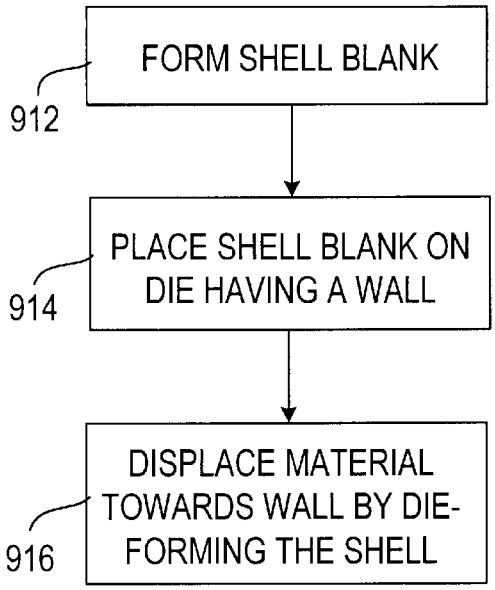

According to one embodiment, the shell 112 may be reformed by coining some or, preferably all, peripheral areas of the shell. As best seen in FIGS. 2 and 3, in one embodiment the shell 112 is positioned 914 (FIGS. 9A and 9B) over or within the cavity 121 of a die 122. The die 122 has an annular surface 124 for receiving and supporting at least the annular periphery of the shell 112. Adjacent the outer edge of the support 124 is an upstanding wall region 126 of the die. The wall 126 defines the desired shape (such as circular) and diameter of the shell.

Figure 6:
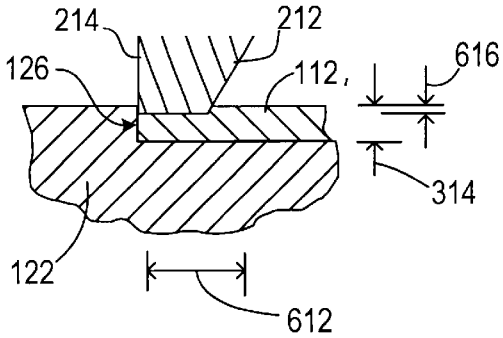
FIG. 6 is a enlarged detail view of region 6 of FIG. 5.

As depicted in FIGS. 2, 3, 5 and 6, a punch 212 is configured to cooperate with the die 122, to perform coining as described more thoroughly below. The punch 212 includes an outer cylindrical wall 214 with a shape and diameter to match (preferably with close tolerance) the shape and diameter of the die wall 126. The coining surface defines a generally annular flat region 216 extending radially inward a distance 612 (FIG. 6). In one embodiment, when the coining includes contacting an annular region of said shell blank with a contact surface of a punch, the contact surface of the punch has a shape corresponding to the annular region.

Figure 1:
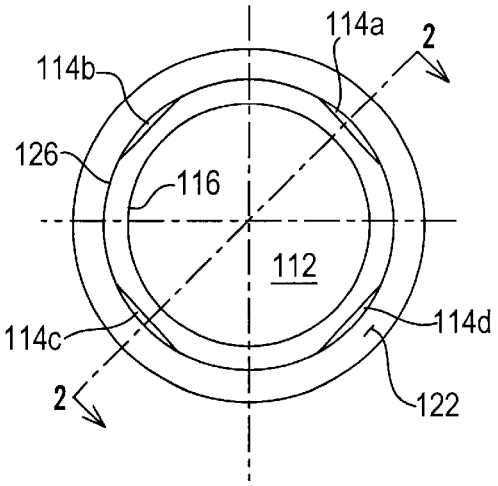
FIG. 1 is a top plan view of an unreformed shell positioned in a coining die according to an embodiment of the present invention.
Figure 4:
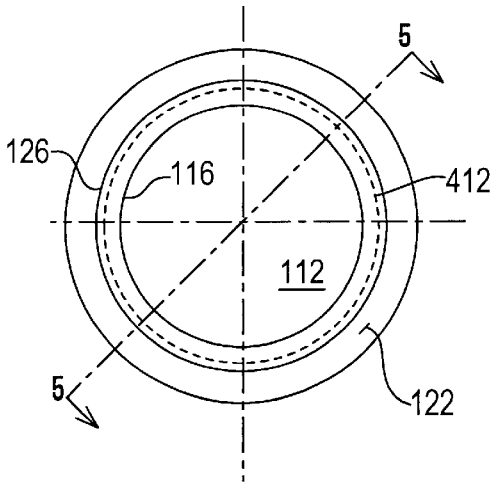
FIG. 4 is a top plan view corresponding to the view of FIG. 1 but after a coining operation has been performed.
Figure 2:
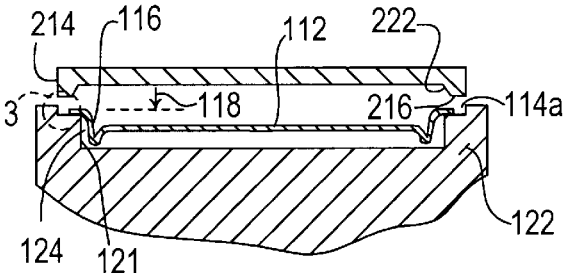
FIG. 2 is a cross sectional view of the shell and die taken along line 2—2 of FIG. 1, also showing a coining punch, according to an embodiment of the present invention.
Figure 5:
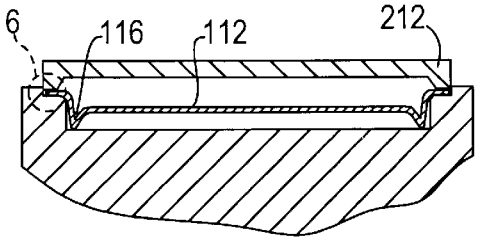
FIG. 5 is a cross sectional view taken along line 5—5 of FIG. 4.

In practice, a shell 112 is positioned in the cavity of the die 122 as depicted in FIGS. 1 and 2. The punch 212 is brought downward 218 with sufficient force to achieve coining as described below. At the maximum downward stroke of the punch 212, as depicted in FIGS. 5 and 6, the punch 212 causes plastic deformation of the metallic peripheral region of the shell. The coining process causes the coined area 412 (FIG. 4), to be reduced 616 in thickness, compared to the thickness 314 of the area prior to coining. The coining also results in shell material being displaced into the scalloped or gap regions 114*a,b,c,d* so that the coin material flows, generally in a net radially outward direction until it meets the die wall 126, as depicted in FIG. 6, thus achieving a shell periphery which has the regularity (and diameter) of the die wall 126.

In general, the total reduction in volume (the reduction in thickness) 616 times the area of the coined region 412 will not be substantially greater than the total volume of the pre-coining scalloped regions or gaps 114*a,b,c,d*. Thus, it is anticipated that, for most situations, the coining will provide a reduction in thickness 616 of the periphery region of the shell which is small enough so as to not seriously affect the strength or integrity of the shell. However, to the extent that there might otherwise be some reduction in strength or integrity, there is an offsetting factor of an increase in hardness resulting from the work-hardening effect of the coining process in the coined area 412.

Figure 7:
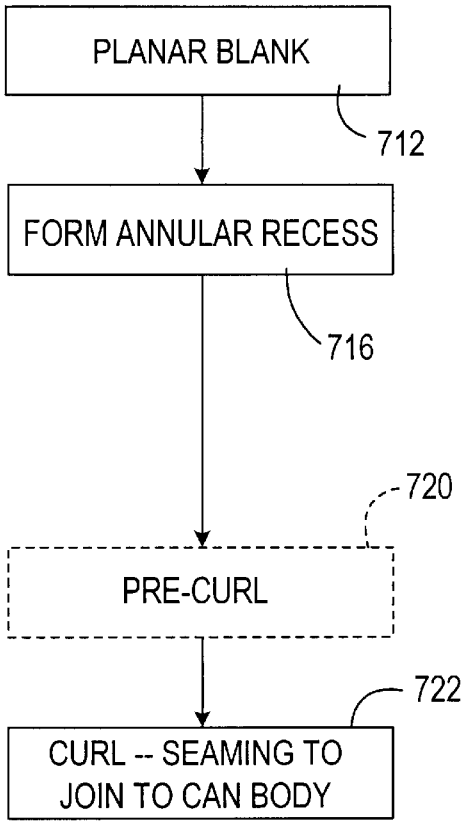
FIG. 7 (Prior Art)
FIG. 7 is a flow chart showing selected steps in a shell forming and seaming operation according to previous procedures.

As shown in FIG. 7, previous procedures typically involved receiving a planar blank 712, forming 716 an annular recess 116 or otherwise shaping the blank. As described above, in previous procedures the shell was curled and seamed to join the can body 722, often after a pre-curl operation 720.

Figure 8:
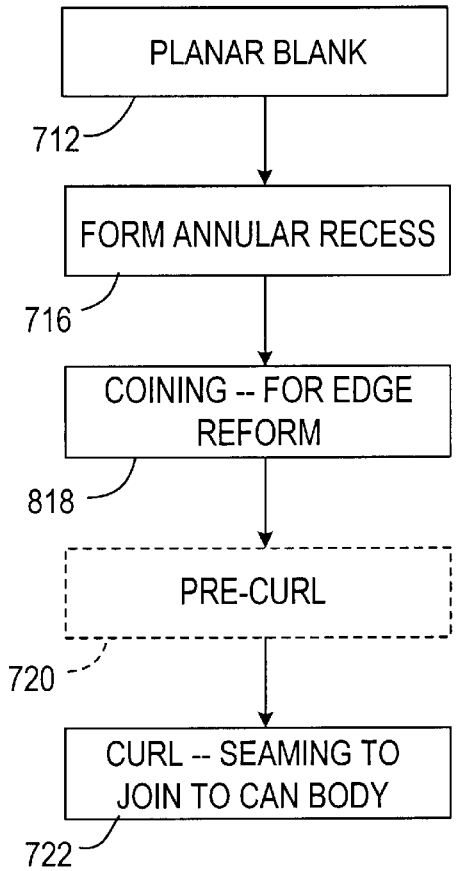
FIG. 8 is a flow chart showing selected steps of a shell formation and seaming procedure, including coining according to embodiments of the present invention.

As depicted in FIG. 8, the present invention preferably adds a process of coining to achieve edge reform 818, prior to the curling step 722 (and preferably prior to a pre-curl 720 end, and in the depicted embodiment, after other forming steps such as forming the annular recess 716.

In view of the above description, a number of advantages the present invention can be seen. The present invention reduces or eliminates the effects of nonregularity or scalloping of blank or shell edges. Containers with smaller seam sizes can be achieved without compromising seam integrity or durability. Seam areas are provided which have been work-hardened and the increase in diameter arising form the coining operation results in savings of material.

A number of variations and modifications of the invention can be used. It is possible to use some features of the invention without using others. For example, it is possible to use the present invention for providing work hardening of the peripheral area of the shell without necessarily fully eliminating earring gaps. Although the present invention has been illustrated with examples of shells with circular ideal peripheries, the present invention could be used for shells (and containers) with noncircular shape such as ellipses, ovals, polygonal cross sections and the like. Although one example of a radial extent 612 of a coining area has been provided, the present invention can be used with larger or smaller coining areas. Although the present invention has been illustrated by examples in which the coining operation is performed as a separate operation, it is possible to design processes in which the coining operation as described herein is performed simultaneously when one or more other operations such as a scoring operation, a recess or rib-forming operation, and the like. Although the depicted embodiment provides for a annular coining area which lies in a plane substantially parallel to the plane of the major web region of the shell, the coining area can be differently oriented. Although in the depicted embodiment, the inner wall 222 of the punch is conically shaped, (to assist in punch withdrawal) while the outer wall 214 is cylindrical, it is possible to provide a (preferably slight) bevel or angle to the outer wall (preferably with a corresponding angle to the die wall) to assist in punch withdrawal and/or guidance or alignment. Although the illustrated embodiments provide a punch coining surface 216 substantially parallel to the plane of the shell, it is possible to provide for the bottom surface of the punch (and thus of the resultant coining area) with a (preferably slight) inward or outward bevel. Although the disclosure herein has included a description of coining as a forming operation, other forming operations can also be used and can reduce or eliminate irregularities in the blank periphery, e.g. to permit smaller seams. Examples of other forming operations include spinning 916 (FIG. 9A) or die-forming (918 FIG. 9B). Those of skill in the art will understand how to use spinning or die-forming to reduce or eliminate irregularities, after understanding the present disclosure.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures , functions, ranges or steps are disclosed herein, and without intending to publicly dedicate any patentable subject matter.

What is claimed is:

1. A method of reforming a beverage container shell comprising:

forming a shell blank of a first material, said shell blank having a first perimeter shape which is different from a desired circular, finished-shell perimeter shape;

placing said shell blank on a die which includes a wall having substantially said desired perimeter shape and positioned at a substantially right angle to a die surface means;

displacing an annular region of some of said first material radially outward toward said wall to provide said shell blank with substantially said desired perimeter shape, wherein said displacing step comprises thinning and coining said annular region of some of said first material.

2. A method, as claimed in claim 1, wherein:

said die includes a lower surface, adjacent said wall, for supporting at least an annular region of said shell blank, adjacent said wall.

3. A method as claimed in claim 1 wherein:

said die comprises a coining die with a recess configured to accommodate said first perimeter of said shell blank, wherein said wall comprises a wall of said recess.

4. A method, as claimed in claim 3, further comprising removing said shell blank from said recess.

5. A method as claimed in claim 3, further comprising providing a coining punch having a coining contact surface, said coining contact surface being shaped to coin a coining region, positioned within said recess.

6. A method, as claimed in claim 5, wherein said coining region includes an annular region extending at least about a first distance inward from at least a portion of said wall.

7. A method as claimed in claim 5 further comprising:

coining at least a part of said shell blank by contacting at least some of said shell blank adjacent said portion of said shell blank perimeter shape with said contact surface of said coining punch.

8. A method, as claimed in claim 1, wherein said first material is a metal.

9. A method, as claimed in claim 1, wherein said first material is an aluminum alloy.

10. A method as claimed in claim 1 wherein at least a portion of said shell blank perimeter shape is spaced from an adjacent portion of said wall to define at least a first gap.

11. A method, as claimed in claim 10, wherein at least some of said first materials is displaced into at least a portion of said gap.

12. A method of reforming a beverage container shell comprising:

forming a shell blank of a first material said shell blank having a first perimeter shape which is different from a desired circular finished-shell perimeter shape;

placing said shell blank on a die which includes a wall having substantially said desired perimeter shapers;

wherein said die includes a lower surface adjacent said wall for supporting at least an annular region of said shell blank, adjacent said wall;

displacing some of said first material toward said wall to provide said shell blank with substantially said desired perimeter shape;

wherein said step of displacing comprises coining said annular region.

13. A method, as claimed in claim 12, wherein:

said coining includes contacting at least said annular region of said shell blank with a contact surface of a punch which has a shape corresponding to said annular region.

14. A method, as claimed in claim 12, wherein at least a portion of said shell blank is not coined in said step of coining.

15. A method, as claimed in claim 12, wherein said coining displaces said first material so as to position substantially all of the perimeter of said shell blank in contact with said wall.

16. A method, as claimed in claim 12, further comprising forming an annular recess in said shell blank prior to said step of coining.

17. An apparatus for reforming a beverage container shell comprising:

means for placing a shell blank in a die, said shell blank formed of a first material and having a first perimeter shape which is different from a desired circular, finished-shell perimeter shape, wherein said die includes a wall means positioned in an opposing relationship from said shell blank for defining substantially said desired perimeter shape; and means, movable with respect to said die, for displacing at least some of said first material radially outwardly toward said wall means to provide said shell blank with substantially said desired circular, finished-shell perimeter shape, wherein said means for displacing comprises means for coining and thinning said first material proximate to said wall means.

18. Apparatus as claimed in claim 17, wherein said die includes surface means, adjacent said wall means, for supporting at least an annular region of said shell blank adjacent said wall.

19. The apparatus of claim 17, wherein said die comprises a coining die with a recess configured to accommodate said first perimeter shape of said shell blank.

20. Apparatus as claimed in claim 19 wherein said wall means comprises a wall of said recess.

21. Apparatus as claimed in claim 19 further comprising a coining punch having a coining contact surface, said coining contact surface shaped to coin a coining region, positioned within said recess, said coining region extending at least about a first distance inward from at least a portion of said wall means.

22. Apparatus as claimed in claim 21 wherein said means for displacing comprises means for coining at least a part of said shell blank by contacting said at least a part of said shell blank with said contact surface of said coining punch.

23. Apparatus as claimed in claim 17 wherein at least a portion of said shell blank perimeter is spaced from an adjacent portion of said wall means to define at least a first gap.

24. Apparatus as claimed in claim 23, wherein at least some of said first material is displaced into at least a portion of said first gap.

25. Apparatus for reforming a beverage container shell comprising:

means for placing a shell blank in a die, said shell blank formed of a first material and having a first perimeter shape which is different from a desired circular, finished-shell perimeter shape, wherein said die includes a wall means for defining substantially said desired perimeter shape;

wherein said die includes surface means, adjacent said wall means, for supporting at least an annular region of said shell blank adjacent said wall said wall means oriented at a substantially right angle to said surface means; and means, movable with respect to said die, for displacing at least some of said first material toward said wall means to provide such shell blank with substantially said desired perimeter shape, wherein said means for displacing comprises means for coining and thinning said annular region of said shell blank adjacent said wall.

26. Apparatus as claimed in claim 25, wherein said means for coining includes means for contacting at least said annular region of said shell blank with a contact surface of a punch which has a shape corresponding to said annular region.

* * * * *